US008702449B2

(12) United States Patent
Provost et al.

(10) Patent No.: US 8,702,449 B2
(45) Date of Patent: Apr. 22, 2014

(54) CONNECTOR ASSEMBLY WITH RETAINING INSERT

(75) Inventors: Christophe Provost, Cherre (FR); Samuel Joubert, Saint Corneille (FR); Pascal Ribeau, Le Mans (FR); Guillaume Seclet, Souday (FR)

(73) Assignee: Souriau, Versailles (FR)

( * ) Notice: Subject to any disclaimer, the term of this patent is extended or adjusted under 35 U.S.C. 154(b) by 0 days.

(21) Appl. No.: 13/438,946

(22) Filed: Apr. 4, 2012

(65) Prior Publication Data

US 2012/0258621 A1 Oct. 11, 2012

(30) Foreign Application Priority Data

Apr. 5, 2011 (FR) ..... 11 52945

(51) Int. Cl.
*H01R 13/40* (2006.01)

(52) U.S. Cl.
USPC ..... 439/586; 439/595

(58) Field of Classification Search
USPC ..... 439/586, 592–601, 603, 752, 733.1, 439/744, 751–752.5
See application file for complete search history.

(56) References Cited

U.S. PATENT DOCUMENTS

| | | | | |
|---|---|---|---|---|
| 3,259,871 | A | 7/1966 | Chandler | |
| 3,842,389 | A * | 10/1974 | Glover et al. | 439/273 |
| 3,963,295 | A * | 6/1976 | Askman et al. | 439/276 |
| 7,722,397 | B2 * | 5/2010 | Schleith | 439/595 |

FOREIGN PATENT DOCUMENTS

| | | |
|---|---|---|
| EP | 0655804 | 5/1995 |
| EP | 0913888 | 5/1999 |
| GB | 587643 | 5/1947 |

OTHER PUBLICATIONS

French Search Report dated Oct. 17, 2011, corresponding to the Foreign Priority Application No. 11 52945.

* cited by examiner

*Primary Examiner* — Khiem Nguyen
(74) *Attorney, Agent, or Firm* — Young & Thompson

(57) ABSTRACT

A connector assembly including at least an insert (1), the insert including:

a front part (11) and a rear part (10) made from a hard insulating material, joined together, at least one longitudinal housing (12) crossing through the front part (11) and the rear part (10) of the insert, this longitudinal housing (12) being capable of accommodating a female electrical contact (6), characterized in that the insert (1) includes at least one soft insulating material (20, 21) at least partially surrounding the female electrical contact (6) and absorbing the vibration of the female electrical contact.

16 Claims, 2 Drawing Sheets

RELATED ART

CONNECTOR ASSEMBLY WITH RETAINING INSERT

FIELD OF THE INVENTION

The invention relates to a connector assembly provided with an insert for retaining an electrical contact in order to minimize the vibrations of said electrical contact within said insert.

The invention has applications in the field of connector technology and, specifically, in the fields of aerospace connectors, automotive connectors, and any other field using connectors in a harsh environment.

PRIOR ART

In the field of connector technology, there are connector assemblies equipped with inserts made in two sections in order to allow an electrical contact to be mounted inside of each insert. These inserts usually each include a front part and a rear part, made using a hard insulating material, such as a hard thermoplastic. The front part and the rear part of an insert are joined together, usually with glue, so as to prevent the assembly from becoming disconnected and to provide electrical insulation of the electrical contact.

An example of such an insert is shown in FIGS. 1A and 1B. FIG. 1A shows a side section view of a connector assembly according to the prior art. FIG. 1B shows a section along a profile view of a connector assembly according to the prior art. This connector assembly includes an insert 1 surrounding a female electrical contact. The insert 1 includes at least one longitudinal cavity 12, or longitudinal housing, intended to accommodate the female electrical contact 6. The female electrical contact 6 is fixed inside of the insert 1, in the cavity 12, by means of a retainer clip 4, usually made of metal. This retainer clip 4 not only retains the female electrical contact in the insert, but it also allows said female electrical contact to be disassembled.

The insert 1 consists of two parts: a front part 11 and a rear part 10 joined together. The longitudinal cavity 12 if formed through the two front and rear parts of the insert. In other words, the longitudinal cavity 12 crosses through the front 11 and rear part 10 of the insert 1. This longitudinal cavity 12 is capable of accommodating a female electrical contact. The female contact is itself intended to connect with a male electrical contact.

FIG. 1B shows an insert 1 provided with multiple longitudinal cavities 12, each cavity 12 receiving a female electrical contact 6.

The insert 1 is usually equipped with a grommet 7 made of a soft material, joined to the rear part of the insert. The role of this grommet 7 is to form the seal of the female contact 6 inside of the insert by exerting a radial pressure on the electrical cable mounted at the rear of the contact. Usually, the inside diameter of the grommet's opening is less than the diameter of the cable in order to provide this pressure on the cable. FIG. 1B shows an example grommet 7 exiting the insert, meaning that it is joined to the rear part 10 of the insert. Such a grommet can also be mounted entering the insert, meaning that it is joined to the front part 11 of said insert, when the contact is a male contact. It is then called an interfacial seal, to distinguish it from the rear part. This soft interfacial seal exerts a radial pressure on the diameter beyond the male contact.

As is understood from these drawings, by its clip attachment design, the insert 1 includes a mechanical clearance between the female contact 6 and the wall of the longitudinal cavity 12, this clearance allowing the assembly, or the disassembly, of the female contact 6 in the insert 1. A clip attachment mechanism does not allow a connection between the insert and the electrical contact without an operating clearance. However, when using the connector assembly in a harsh environment, meaning an environment with bumps and/or vibrations, the clearance between the female contact 6 and the wall of the cavity 12 being the cause of premature wear of the insert. During temperature and vibration testing, it was revealed that microscopic displacements of the female contact on the insert, allowed by the mechanical clearances, generate wear of the insert, which creates dust pollution in the longitudinal cavity 12, disrupting the electrical operation of the female contact. More specifically, during vibrations, the female electrical contact rubs on the clip 4 at the rear of the insert, over the entire wall of the longitudinal housing 12. All of this rubbing creates wear of the wall of the longitudinal housing with dust that disrupts the proper operation of the female contact and causes premature wear of the insert.

DESCRIPTION OF THE INVENTION

The purpose of the invention is precisely to overcome the disadvantages of the techniques described earlier. To this end, the invention proposes a connector assembly equipped with an insert comprising an element made of a soft material that retains, without clearance, the female electrical contact in the longitudinal housing.

This soft material element can be a sheath mounted inside of the longitudinal houses or an intermediate slice inserted in the front part of the insert. Regardless of its embodiment, this soft material element absorbs the vibrations of the female contact, thereby preventing the contact from rubbing against the walls of the longitudinal housing of the insert.

More specifically, the invention relates to a connector assembly including at least an insert, said insert comprising:

- a front part and a rear part made from a hard insulating material, joined together,
- at least one longitudinal housing crossing through the front part and the rear part of the insert, this longitudinal housing being capable of accommodating a female electrical contact,
- characterized in that the insert includes at least one soft insulating material at least partially surrounding the female electrical contact and absorbing the vibration of said female electrical contact.

This connector assembly may include one or more of the following characteristics:

- The soft insulating material is a sheath inserted into the longitudinal housing and longitudinally surrounding the female electrical contact.
- The insert includes multiple sheaths made of a soft insulating material, each sheath being mounted in a longitudinal houses, around a female electrical contact.
- The sheath includes an inside wall fitting the shape of the female electrical contact and an outside wall fitting the shape of the inside wall of the longitudinal housing.
- The female electrical contact is mounted by being slightly tightened on the inside of the sheath.
- The soft insulating material is an intermediate slice inserted between two slices of the front part of the insert and radially surrounding the female electrical contact.
- The intermediate slice of the insert is joined with the two slices of the front part of the insert.
- The intermediate slice radially surrounds multiple female electrical contacts.

Each female electrical contact is force-fitted on the inside of the intermediate slice.

The soft insulating material is a TEFLON (fluorinated polymer) or a soft thermoplastic.

DETAILED DESCRIPTION OF THE EMBODIMENTS OF THE INVENTION

Figure 1A:
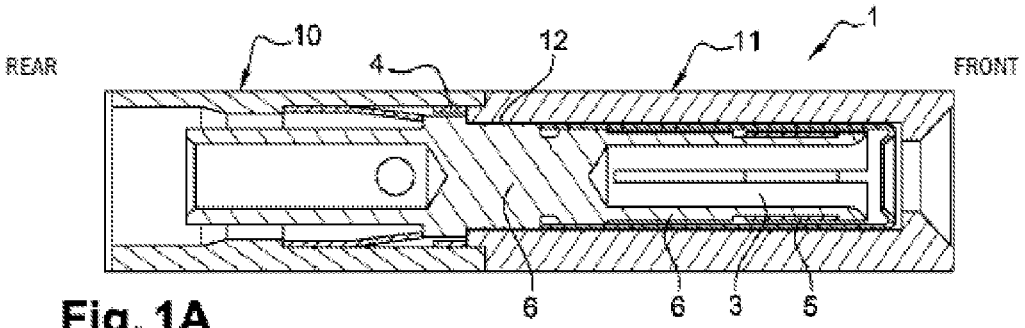
Fig. 1A RELATED ART
FIGS. 1A and 1B, already described, show section views of an insert for a female electrical contact in the prior art.
Figure 1B:
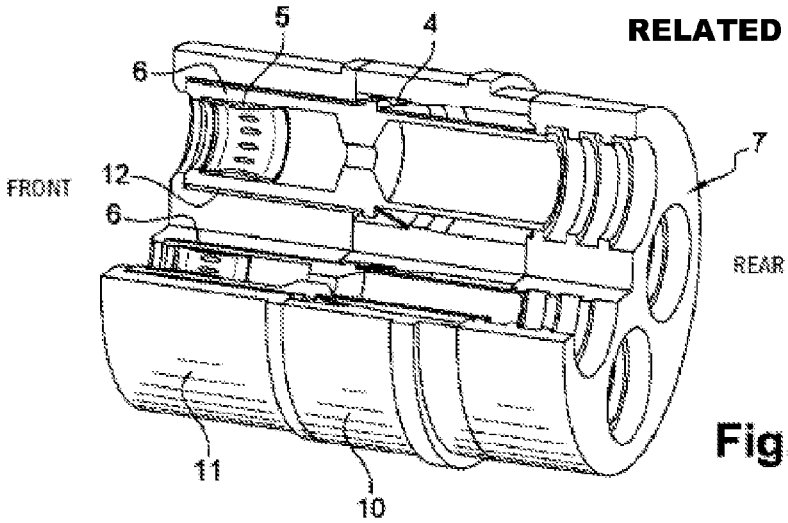
Figure 4:
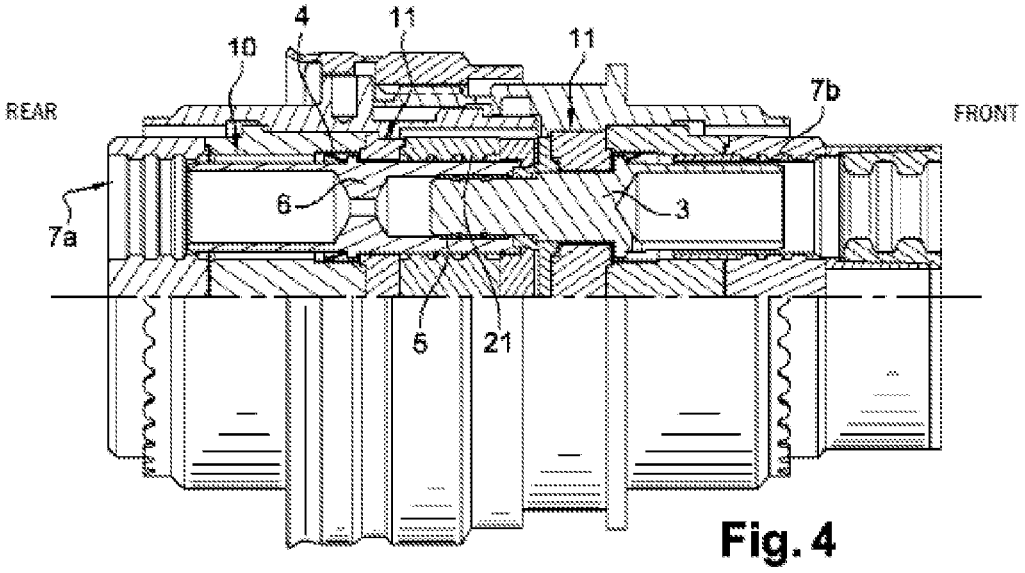
FIG. 4 shows a full view of a connector assembly including an insert like the one in FIG. 3.

The invention relates to a connector assembly equipped with an insert designed to accommodate and retain a female electrical contact without a mechanical clearance. An example of such a connector assembly is shown in FIG. 4. This connector assembly includes an insert 1 comprising a front part 11 and a rear part 10 joined together. It further includes a first grommet 7*a* joined with the front part 11 of the insert and a second grommet 7*b* joined with the rear part 10 of the insert.

The insert 1 includes one or more longitudinal cavities or housings 12 each intended to accommodate a female electrical contact 6. This longitudinal housing 12 crosses through the rear part 10 and the front part 11 of the insert. The female electrical contact 6 is attached to the insert 1 by means of a clip mechanism 4 mounted in the rear part of the insert. This clip mechanism 4 allows the female electrical contact 6 to be retained in the longitudinal cavity 12. By means of an appropriate tool, it also allows the female electrical contact to be disassembled in order to remove it from the insert.

In this FIG. 4, the connector assembly is shown for when a male electrical contact 3 is inserted into the female contact 6. In this situation, the electrical connection between the male contact 3 and the female contact 6 is provided by means of an elastic strip 5, placed between the female contact and the male contact.

The connector assembly of the invention includes means for retaining the female contact in the longitudinal cavity without a mechanical clearance. These means of retaining consist of an element made of a soft insulating material at least partially surrounding the female contact. FIG. 4 shows the insert of the invention in one of the embodiments of the soft insulating material element. This embodiment will be described in more detail with reference to FIG. 3.

Figure 2:
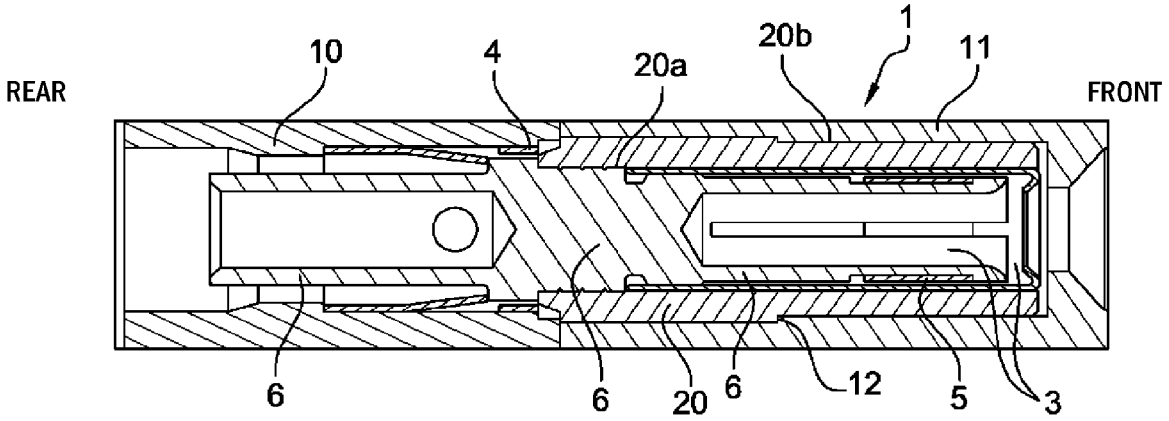
FIG. 2 shows a longitudinal section view of a first embodiment of an insert for a female electrical contact according to the invention.

FIG. 2 shows another embodiment of the insert of the invention. In this embodiment, the soft insulating material element is a sheath 20 mounted along the wall of the longitudinal cavity 12, meaning along the inside wall of the insert. This sheath 20 is mounted around the female electrical contact. The intrinsic characteristics of the material making up the sheath 20 absorb the vibrations of the female contact. The sheath thus forms a shock-absorbing layer around the female electrical contact 6, which has the effect of absorbing any impact of said female contact against the inside wall of the insert 1, thereby protecting the insert during vibrations.

For this, the sheath 20 is made of a soft plastic material that is capable of damping the vibrations of the female contact. This plastic material can be a material from the PTFE (polytetrafluoroethylene) family or a soft thermoplastic that is capable of resisting high temperatures.

The sheath 20 has outside dimensions that fit the shape of the longitudinal cavity 12 of the insert 1 and inside dimensions that fit the outside dimensions of the female contact 6. To provide a perfect fit between the female contact 6 and the sheath 20, said female contact is mounted by being slightly tightened to the inside of said sheath. It is mounted by penetration in the sheath, from the rear part 10 of the insert toward the front part 11 of said insert. The female contact is tightened by the intrinsic characteristics of the material that makes up the sheath and by the fact that the inside diameter of the sheath is slightly less than that of the contact part. This way, there is no mechanical clearance around the female contact. Similarly, because the dimensions of the sheath fit the dimensions of the cavity of the insert, the mechanical clearance between the sheath 20 and the inside wall of the insert 1 is minimal. However, if there must be a clearance, the vibrations of the sheath would be absorbed by the sheath itself, given the absorbent characteristics of the material of which it is made.

As shown in FIG. 2, the sheath 20 surrounds only a part of the female contact 6, namely the part of the female contact located in the front part of the insert up to the clip mechanism 4. The sheath does not surround the female contact at the clip 4 so as to allow the female contact 6 to be assembled and disassembled in the insert 1. It is understood, however, that when the female contact is retained on a part of its length (preferably on at least half of its total length), the female contact no longer rubs the clip or the part of the inside wall of the insert that is not protected by the sheath 20 because the sheath absorbs the vibrations of the female contact.

As explained above, the insert 1 can include multiple longitudinal cavities each intended to accommodate a female contact. In this case, a sheath 20 is installed in each longitudinal cavity 12 of the insert 1 in order to each retain a female contact 6. Therefore, in this embodiment, an insert includes as many sheaths as there are longitudinal cavities.

Figure 3:
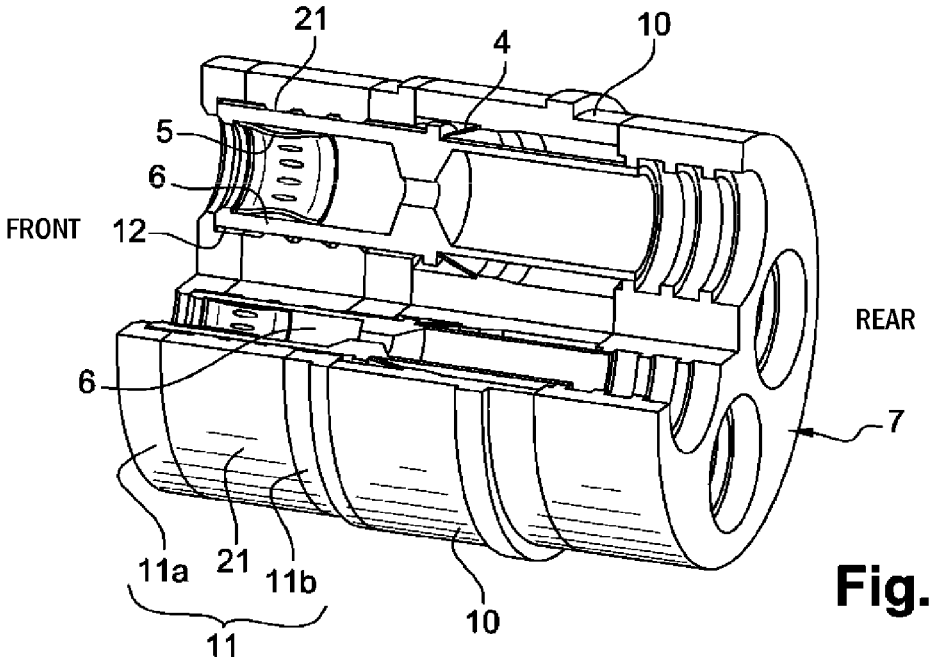
FIG. 3 shows a profile section view of a second embodiment of an insert for a female electrical contact according to the invention.

FIG. 3 shows an insert according to a second embodiment of the invention. In this embodiment, the element made of a soft insulating material is an intermediate slice 21 placed within the front part 11 of the insert 1. This intermediate slice 21 is placed between two slices of hard material in the front part. It thus constitutes a layer of soft material between two layers of hard material of the front part 11 of the insert. This intermediate slice 21 is joined between two slices 11*a* and 11*b* of hard thermoplastic material.

This way, the insert 1 includes multiple slices, or layers, namely a layer of a hard thermoplastic material forming the rear part 10 of the insert, a slice of hard thermoplastic material forming the slice 11*b* of the front part 11 of the insert, an intermediate slice made of a soft insulating material, and finally a slice made of a hard thermoplastic material forming the layer 11*a* of the front part 11 of the insert. The intermediate slice 21 has outside dimensions that match the outside dimensions of the slices 11*a* and 11*b* of the insert. Also, like slices 11*a* and 11*b*, they include multiple cavities 12 each intended to accommodate a female contact 6. The dimensions of the cavities 12 of the intermediate slice 21 fit the outside dimensions of the female contact 6 so that the female contact 6 fits, without clearance, in said cavity of the intermediate slice 21.

In this embodiment, the intermediate slice 21 can be made of a soft thermoplastic or an elastomer.

As seen in FIG. 3, the intermediate slice 21 surrounds the female electrical contact 6 on part of the length of the female contract, but over the entire length of said contact. As in the embodiment described above, the intrinsic characteristics of the material from which the intermediate slice 21 is made absorb the vibrations of the female electrical contact, which has the effect of preventing the female contact from rubbing on the clip mechanism 4 and/or on the inside wall of the insert, and specifically the rear part of the insert.

In this embodiment, the intermediate slice has multiple cavities, meaning that it includes multiple cavities and absorbs the vibrations of the female contacts in all of the cavities. In this embodiment, the insert includes a single element made of a soft insulating material, regardless of the number of cavities it contains.

Regardless of the embodiment of the soft insulating material element of the insert of the invention, the characteristics of this element allow it not only to retain the female contact in its cavity but also to fill the mechanical clearances in order to prevent microscopic displacements and rubbing of the female contact in the cavity of the insert. This therefore prevents any internal production of dust that could disrupt the operation of the electrical contact. Furthermore, this soft insulating material element, by its constitution, forms a sealing barrier around the female electrical contact, preventing any outside dust from migrating to the inside of the cavities.

Regardless of the embodiment of the soft insulating material element of the invention, once said element is in place, the other elements of the connector assembly are assembled as standard. The same is true for disassembling the connector assembly.

The invention claimed is:

1. A connector assembly including at least an insert (1), said insert comprising:

a front part (11) and a rear part (10) made from a hard insulating material, joined together;

at least one longitudinal housing (12) crossing through the front part (11) and the rear part (10) of the insert, the longitudinal housing (12) being capable of accommodating a female electrical contact (6);

a first grommet (7*a*) joined with the front part (11) of the insert and a second grommet (7*b*) joined with the rear part (10) of the insert, the grommets being made of a soft material;

and at least one element made of a soft insulating material (20, 21) at least partially surrounding the female electrical contact (6) to retain, without clearance, the female electrical contact in the longitudinal housing and to absorb the vibrations of said female electrical contact.

2. The connector assembly according to claim 1, wherein the soft insulating material element is a sheath (20) inserted into the longitudinal housing (12) and longitudinally surrounding the female electrical contact (6).

3. The connector assembly according to claim 2, wherein the insert (1) includes multiple sheaths (20) made of a soft insulating material, each sheath being mounted in a longitudinal housing, around a female electrical contact.

4. The connector assembly according to claim 2, wherein the sheath (20) includes an inside wall (20*a*) fitting the shape of the female electrical contact and an outside wall (20*b*) fitting the shape of the inside wall of the longitudinal housing.

5. The connector assembly according to claim 2, wherein the female electrical contact (6) is mounted by being slightly tightened to the inside of the sheath (20).

6. The connector assembly according to claim 1, wherein the soft insulating material element is an intermediate slice (21) inserted between two slices (11*a*, 11*b*) of the front part (11) of the insert and radially surrounding the female electrical contact.

7. The connector assembly according to claim 6, wherein the intermediate slice (21) of the insert is joined with the two slices (11*a*, 11*b*) of the front part of the insert.

8. The connector assembly according to claim 6, wherein the intermediate slice (21) radially surrounds multiple female electrical contacts (6).

9. The connector assembly according to claim 6, wherein each female electrical contact (6) is mounted by being slightly tightened to the inside of the intermediate slice (21).

10. The connector assembly according to claim 1, wherein the soft insulating material is a polytetrafluoroethylene material, an elastomer, or a soft thermoplastic that is capable of resisting high temperatures.

11. The connector assembly according to claim 3, wherein the sheath (20) includes an inside wall (20*a*) fitting the shape of the female electrical contact and an outside wall (20*b*) fitting the shape of the inside wall of the longitudinal housing.

12. The connector assembly according to claim 3, wherein the female electrical contact (6) is mounted by being slightly tightened to the inside of the sheath (20).

13. The connector assembly according to claim 4, wherein the female electrical contact (6) is mounted by being slightly tightened to the inside of the sheath (20).

14. The connector assembly according to claim 7, wherein the intermediate slice (21) radially surrounds multiple female electrical contacts (6).

15. The connector assembly according to claim 7, wherein each female electrical contact (6) is mounted by being slightly tightened to the inside of the intermediate slice (21).

16. The connector assembly according to claim 8, wherein each female electrical contact (6) is mounted by being slightly tightened to the inside of the intermediate slice (21).

* * * * *